United States Patent [19]

Schneider

[11] 3,932,287

[45] Jan. 13, 1976

[54] REACTIVE COLD FORMING LUBRICANT

[75] Inventor: Horst Schneider, Frankfurt, Germany

[73] Assignee: Oxy Metal Industries Corporation, Warren, Mich.

[22] Filed: Aug. 7, 1974

[21] Appl. No.: 495,348

Related U.S. Application Data

[63] Continuation-in-part of Ser. No. 216,731, Jan. 10, 1972, abandoned.

[30] Foreign Application Priority Data

Jan. 19, 1971 Germany ..... 2102295

[52] U.S. Cl. ..... 252/32.5; 72/42; 252/49.5

[51] Int. Cl.[2] ..... C10M 1/44; C10M 3/38; C10M 5/24; C10M 7/24

[58] Field of Search ..... 252/32.5, 49.5; 72/42

[56] References Cited

UNITED STATES PATENTS 3,496,104 2/1970 Shimada et al. ..... 252/32.5

*Primary Examiner*—Delbert E. Gantz
*Assistant Examiner*—I. Vaughn
*Attorney, Agent, or Firm*—Arthur E. Kluegel; Richard P. Mueller; Bertram F. Claeboe

[57] ABSTRACT

Disclosed is a stable organic phase coating composition useful for treating a metallic surface prior to non-cutting cold forming which contains from 0.5 to 10 weight % water, from 30 to 94 weight % of an organic lubricant and from 5 to 60 weight % of the reaction product obtained by reacting the salt of a multivalent metal cation, a polyphosphoric acid, and an alcohol of 10 to 36 carbon atoms in a weight ratio of metallic cation: $P_2O_5$ equivalent: alcohol of 1:3–60: 14–150. A major advantage of using this composition to form the lubricant coating on the metallic surface is that the lubricating layer may be applied in a single step instead of by a two-step process as in the past.

14 Claims, No Drawings

REACTIVE COLD FORMING LUBRICANT

CROSS-REFERENCE TO RELATED APPLICATION

This application is a continuation-in-part of U.S. Ser. No. 216,731 filed Jan. 10, 1972 and now abandoned.

BACKGROUND OF THE INVENTION

This invention relates to the art of applying a lubricant coating to a metallic surface which is to be subjected to non-cutting cold forming. Such lubricating layers are necessary primarily in order to avoid striation of the surface of the workpiece, seizure of the workpiece in the drawing die, and damage to the forming die itself.

In the past, it has been common to provide the lubricant layer on the workpiece via a two-stage process. According to this conventional process, the workpiece is first contacted with a phosphate-containing composition in order to form a phosphate-based deposit on the surface by chemical reaction. Thereafter, the workpiece is contacted with an organic lubricant composition such as a soap melt or solution prior to the actual cold forming. Without the prior phosphate coating, the adhesion qualities of the organic lubricant alone have been found to be unsatisfactory for severe cold forming operations.

As an alternative to this two-stage process, attempts have been made to combine the phosphating composition with the organic lubricant in order that one of the stages may be eliminated. Those systems suggested, however, have been water-based systems containing a dissolved phosphate compound with the organic lubricant component being miscible or emulsified therein. The disadvantage of such compositions is that their stability is very poor. Once the organics and the water-soluble components separate as distinct phases, the composition is no longer useful for its intended purpose.

Numerous addition agents such as long chain amines or amides and phosphoric acid esters have been taught for use in lubricant compositions, but no one has suggested the stable organic phase coating composition of the present invention.

SUMMARY OF THE INVENTION

The present invention includes a coating composition useful for treating a metallic surface prior to non-cutting cold forming as well as a process for using the composition and a method of preparing it. The composition contains from 5 to 60 weight % of a reaction product, from 30 to 94 weight % of an organic lubricant of at least 12 carbon atoms and from 0.5 to 10 weight % water and exhibits a pH value of below 3.

The reaction product is obtained by reacting a salt of a multivalent metal cation, a polyphosphoric acid, and an alcohol of 10 to 36 carbon atoms in a weight ratio of metallic cation: $P_2O_5$ equivalent: alcohol of 1:3–60:-14–150. Where the lubricating composition contains low concentrates of the reaction product, the alcohol content is preferably low compared to the multivalent metal cation and polyphosphoric acid.

DETAILED DESCRIPTION OF THE INVENTION

Examples of suitable organic lubricants are the hydrocarbon oils, fatty acids, naturally occurring animal and vegetable oils and the alcohol, ester and amine derivatives of the foregoing. Preferred organic lubricants are the mineral oils, oleic acid and oleyl amine. The viscosity of the mineral oil should be between 2.4 and 15° Engler (50°C). The fatty acids and animal and vegetable oils should have from 8 – 22 carbon atoms. The organic lubricant is preferably present in a concentration of 64 – 89 weight %.

The water content of the composition is very critical. While a small amount of water has been found necessary to catalyze and accelerate the reaction of the phosphate with the metallic surface, an excess of water results in an undue instability of the composition. If the composition becomes unstable and separates into two phases, little reaction occurs probably because the phosphate components are removed from effective contact with the metal surface by virtue of their solubility in the water phase. Desired water concentration may be maintained either by separate addition or via the water content normally present in the other components employed in the composition. Excellent lubricating results are obtained while maintaining acceptable stability when the water content is maintained below 7% and even more preferably between about 1 and 2%. Higher water concentrations may necessitate including surfactants in the composition to maintain phase stability.

The third essential component of the coating composition is a product obtained by combining three specified reactants. The first reactant is a salt of a multivalent metal cation. A preferred multivalent metal is iron. Other suitable cations include zinc, manganese, molybdenum, tungsten, aluminum, lead, magnesium and calcium. The cation is preferably added as the phosphate salt although other salts such as sulfate, nitrate and halides may be employed. The second reactant is a polyphosphoric acid which is preferably 76 to 85 weight % $P_2O_5$ . The third reactant is an alcohol of 10 to 36 carbon atoms and is preferably an alkyl or alkyl aryl alcohol. Most preferably, the alcohol comprises a fatty alcohol of about 18 carbon atoms such as oleyl alcohol. Natural alcohols such as wool fat alcohol are also suitable. The reaction product obtained by combining the foregoing reactants should be present in the composition in an amount of 5 to 60 weight % and preferably in an amount of 10 to 35 weight %.

In order to obtain the desired reaction product, the multivalent metal salt may conventionally be dissolved in the polyphosphoric acid. This reaction results in an exothermic heat of solution. Thereafter, the aforementioned solution is combined with the alcohol and maintained at a temperature of at least 50°C and up to 150°C or higher for a period of at least 30 minutes. Preferably, the temperature is at least 60°C and most preferably at least 70°C. Higher temperatures speed the rate of reaction between the alcohol, the polyphosphoric acid, and the multivalent metal cation.

The reactants should be combined for reaction purposes in a weight ratio of metallic cation : $P_2O_5$ equivalent : alcohol of 1:3–60:14–150. On a mole basis, the corresponding ratios are about 1:1.5–15:3–30.

The composition of the invention may be employed for lubricating many kinds of metals such as steel, alloyed steel, zinc and aluminum. It has found particular use for the treatment of iron and steel. Depending on the viscosity of the organic lubricant employed, the coating composition may vary from very fluid to pasty in consistency.

Application of the lubricant coating to the workpiece may be accomplished in the conventional manner. In the dip technique, the composition is maintained at a temperature of from ambient to 100°C or higher and the workpiece is immersed in the composition for a period of at least one minute. The contact time will depend upon the concentrations of the reactants, the temperature of the composition, as well as the thickness of the deposit desired. Normally, contact periods in excess of 60 minutes are unnecessary. Best results have generally been obtained when the weight of the deposit obtained is between 0.5 and 10 grams per square meter (about 2 – 10 minutes contact time). The composition may also be employed using other conventional techniques such as flooding, wiping, or spraying.

Maintaining the water content at the desired level is critical to the stability of the coating composition. One means for controlling this concentration is to maintain the bath at an elevated temperature such that the rate of water evaporation equals the rate at which water is dragged into the bath on the surface of wet workpieces.

EXAMPLE 1 — LUBRICANT PREPARATION

A reaction product was prepared as follows: 59 g polyphosphoric acid with a $P_2O_5$ content of 84 weight % was heated at 120°C. Then 10 g of technical iron phosphate with an iron content of approximately 30% (40% $Fe^{+3}$, 60% $Fe^{+2}$) was added and dissolved. Then, 150 g of oleylalcohol was added and the reactants were maintained at 70°C for 60 minutes. 15 g of the reaction product were then mixed with 25 g of oleic acid, 53 g of mineral oil with a viscosity of 2.4 to 15° Engler (50°C) and 5 g of oleylamine. Thereafter, 2 g of water were added to bring the total to 100 g.

This lubricant appeared cloudy at room temperature. When heated above 40°C, however, a clear solution was obtained which did not lose its stability when heated for a long period of time at 100°C.

EXAMPLE 2

Welded and scraped pipes of the quality St 35 (outside diameter 44 mm, wall thickness 3 mm) were pickled for a period of 20 minutes at 60°C in inhibited phosphoric acid, rinsed twice in water and then dipped for 10 minutes at 65°C in a lubricant which was prepared as in Example 1 from the following components:

| | | |
|---|---|---|
| 2.5 weight % | Polyphosphoric Acid (84% $P_2O_5$) | -Reaction Product |
| 1 weight % | Technical Iron (II) Phosphate with a content of approx. 17% $Fe^{+2}$ and 13% $Fe^{+3}$ | |
| 15 weight % | Wood Fat Alcohol | |
| 54.5 weight % | Mineral Oil (3° Engler at 50°C) | |
| 20 weight % | Oleic Acid | |
| 5 weight % | Fatty Amine | |
| 2 weight % | Water | |

The pipes were drawn successfully three times without intermediate annealing and without repeated lubricant treatment at a speed of 44 m/minute.

The drawing sequences were (in mm):

1. 44 × 3.0 to 38 × 2.3
2. 38 × 2.3 to 33 × 1.7
3. 33 × 1.7 to 28.2 × 1.4

EXAMPLE 3

Seamless pipes of the quality St 35 were dipped after a reducing annealing for a period of 10 minutes at 65°C in a lubricant that was prepared from the following components:

| | | |
|---|---|---|
| 5 weight % | Polyphosphoric Acid (84% $P_2O_5$) | -Reaction Product |
| 1 weight % | Technical Iron Phosphate | |
| 1.5 weight % | Oleyl Alcohol | |
| 52 weight % | Mineral Oil (3° Engler at 50°C) | |
| 20 weight % | Oleic Acid | |
| 5 weight % | Oleylamine | |
| 2 weight % | Water | |

The pipes were drawn three times successively with very good results without intermediate annealing and without repeated lubricant treatment at a speed of 60 m/min.

The drawing sequences were (in mm):

30 × 2.6 to 25 × 2.0
25 × 2.0 to 21 × 1.75
21 ×1.75 to 18 × 1.5

EXAMPLE 4

Coiled pipes with a length of approx. 40 m were drawn by means of a suspended mandrel at a speed ranging from 100 to 400 m/minute. The reductions of the cross-sectional areas were approximately 30%. Before drawing, the pipes were treated with a lubricant prepared from the following components:

| | | |
|---|---|---|
| 13.6 weight % | Polyphosphoric Acid (84% $P_2O_5$) | -Reaction Product |
| 0.9 weight % | Technical Iron Phosphate | |
| 13.6 weight % | Oleyl Alcohol | |
| 47.4 weight % | Mineral Oil (3° Engler at 50°C) | |
| 18.2 weight % | Oleic Acid | |
| 4.5 weight % | Oleylamine | |
| 1.8 weight % | Water | |

During the lubricating process, approximately 10 ml of the lubricant were inserted into the pipe behind the mandrel. For the outside lubrication, the lubricant was applied in front of the drawing tool while rotating.

What is claimed is:

1. A stable organic phase coating composition useful for treating a metallic surface prior to non-cutting cold forming, consisting essentially of:

a. 5 to 60 weight % of the reaction product obtained upon mixing as reactants
   1. a salt of a multivalent metal cation,
   2. a polyphosphoric acid, and
   3. an alcohol of 10 – 36 carbon atoms, in a weight ratio of metallic cation: $P_2O_5$ equivalent: alcohol of 1: 3–60: 14–150;

b. 30 to 94 weight % of an organic lubricant of at least 12 carbon atoms; and c. 0.5 to 10 weight % water.

2. The coating composition of claim 1 wherein said reaction product is obtained by maintaining said reactants in contact for at least 30 minutes before combining with said organic lubricant.

3. The coating composition of claim 2 wherein said reaction product is obtained by maintaining said reactants at a temperature of at least 50°C during the contact period.

4. The coating composition of claim 1, wherein the organic lubricant comprises at least one compound selected from the group consisting of the hydrocarbon oils; fatty acids; naturally occurring animal and vegetable oils; the alcohol, ester and amine derivatives of the foregoing; and mixtures thereof.

5. The coating composition of claim 4 consisting essentially of 10 to 35 weight % reaction product; 64–89 weight % organic lubricant; and about 1–2 weight % water.

6. The coating composition of claim 1 wherein said multivalent metal cation is iron; the polyphosphoric acid is about 76–85 weight % $P_2O_5$ equivalent; the alcohol comprises an alkyl or alkylaryl alcohol; and said organic lubricant includes at least one member selected from the group consisting of mineral oil of viscosity 2.5°–15° Engler, oleic acid and oleylamine.

7. A process of preparing a base metal surface for cold forming in one step comprising contacting said surface with the coating composition of claim 1.

8. A process of preparing a base metal surface for cold forming in one step comprising contacting said surface with the coating composition of claim 6.

9. A process for preparing a coating composition as defined in claim 1 comprising dissolving the multivalent metal salt in the polyphosphoric acid, thereafter combining the solution with the alcohol and, after a reaction period of at least 30 minutes, combining the reaction product thereof with the organic lubricant and any additional water required to obtain the desired concentrations of the components.

10. The process of claim 9 wherein the reactants are maintained at a temperature of at least 50°C during the reaction period.

11. The process of claim 10 wherein the reactants are maintained at a temperature in excess of 70°C for about 1 hour.

12. The composition of claim 4 wherein the organic lubricant contains a hydrocarbon oil and fatty acid compound.

13. The composition of claim 12 wherein the organic lubricant further contains a fatty acid amine compound.

14. The composition of claim 13 wherein the organic lubricant comprises about 47.4 to 54.5 weight percent mineral oil; about 18.2 to 20.0 weight percent oleic acid and about 4.5 to 5.0 weight percent oleyl amine.

* * * * *